United States Patent [19]

Bergmann

[11] Patent Number: 4,547,167

[45] Date of Patent: Oct. 15, 1985

[54] APPARATUS AND METHOD FOR MAINTAINING ALTITUDE AND ATTITUDE OF A NEUTRAL BUOYANCY BALLOON

[76] Inventor: David E. Bergmann, 722 E. 6th St., St. Paul, Minn. 55106

[21] Appl. No.: 460,170

[22] Filed: Jan. 24, 1983

[51] Int. Cl.[4] ..... A63H 3/06; B64C 17/00

[52] U.S. Cl. ..... 446/220; 40/214; 244/33; 446/226

[58] Field of Search ..... 46/87, 88, 89, 90; 40/214; 244/33; D21/84; 446/220, 226, 221-225

[56] References Cited

U.S. PATENT DOCUMENTS 3,230,663 1/1966 Shabran ..... 46/90
4,307,537 12/1981 Bergmann ..... 46/87

FOREIGN PATENT DOCUMENTS

WO82/02840 9/1982 PCT Int'l Appl. ..... 446/220

OTHER PUBLICATIONS

Vivian-"The Hoardings of Air" pp. 507-513 incl. of the Strand Magazine for Jun., 1902.

*Primary Examiner*—F. Barry Shay

[57] ABSTRACT

An airborne, free floating, lift-weight, balanced balloon having a closed envelope encompassing a fixed volume of lighter-than-air gas has ballast means fixed on the bottom of the envelope to tend to balance the weight of the balloon to equal the lifting effect of the gas, and to tend to cause the balloon to float in a desired horizontal attitude. At least one ballast member or a pair of ballast members form part of the ballast means and are fixed to the bottom of the balloon in symmetrical relationship to a vertical plane passing through the central horizontal axis of the balloon, ballast member(s) being constituted as a plurality of pressure sensitive removable weight control modules also arranged symmetrically with respect to a vertical plane passing through the central horizontal axis of the balloon when the balloon is in its desired attitude. These weight control modules are removed one or two at a time in order to balance the weight of the balloon so that it will float at a desired altitude. These weight control modules are removed from locations on the skin of the balloon such that the desired attitude of the balloon will be maintained or reestablished.

9 Claims, 9 Drawing Figures

40
42
44
53
54
55
56
57
70
71
73
78
80
81
83
88
90
91
93
98

APPARATUS AND METHOD FOR MAINTAINING ALTITUDE AND ATTITUDE OF A NEUTRAL BUOYANCY BALLOON

BACKGROUND OF THE INVENTION

1. Field of the Invention

This invention has relation to a toy amusement device, advertising sign, or other object which is designed to float at a desired altitude and a predetermined attitude. Such a balloon will include a relatively light, gas impervious, closed envelope filled with lighter-than-air gas to counterbalance the weight of the enveloping structure.

2. Description of the Prior Art

It is known to create a balloon which is lighter than air and has to be tethered to keep it from escaping. See U.S. Pat. No. 1,858,460 to Ranseen, granted in May of 1932. It is known to use a lighter-than-air gas to counterbalance the weight of an encompassing structure to produce a toy which is substantially weightless. See my U.S. Pat. No. 4,307,537 granted to me in December of 1981 and the patents cited therein as follows:

| U.S. Pat. No. | Inventor | Issued |
|---|---|---|
| 1,508,420 | Swartz et al | 9/1924 |
| 1,858,460 | Ranseen | 5/1932 |
| 2,327,665 | Peat | 8/1943 |
| 2,704,267 | Tilden, Jr. | 3/1955 |
| 3,075,243 | Shiplet et al | 1/1963 |
| 3,591,975 | Terc | 7/1971 |
| 3,611,623 | Copstead | 2/1970 |
| 4,038,777 | Schwartz | 8/1977 |
| 4,077,588 | Hurst | 3/1978 |

It is known to remove pressure sensitive weight control modules serially from the bottom of a balloon which is symmetrical about a vertical axis in order to keep the balloon balanced on that vertical axis. See my aforementioned U.S. Pat. No. 4,307,537.

A special search of this invention has not been made, but applicant and those in privity with him are generally familiar with the field as a result of searching and prosecution of the invention resulting in the aforesaid patent to Bergmann, '537.

Neither applicant nor those in privity with him are aware of any closer prior art than that identified above or discussed in this application; nor are they aware of any prior art which anticipates the claims made herein.

SUMMARY OF THE INVENTION

An airborne, free floating, lift-weight balanced balloon of the present invention includes a closed envelope having an outer skin defining a fixed maximum volume, the skin being substantially impervious to passage of the lighter-than-air gas therethrough. The apparatus and method of the invention are designed to be effective on a balloon which is symmetrical about a longitudinally extending vertical plane which includes the balloon's central horizontal axis passing through the center of balance of the balloon, and in which any trace of the balloon lying in a plane at right angles to said central horizontal axis is nonsymmetrical or symmetrical about this central horizontal axis.

Ballast means are fixed to the skin of the balloon envelope to tend to balance the weight of the balloon to equal the lifting effect of the gas, and to tend to cause the balloon to float in a position such that a first trace portion of the skin of the balloon is established as a closed-loop, generally longitudinally extending trace lying in a vertical plane passing through the center of balance of the balloon, and such that a second trace portion of the balloon skin is established as a closed-loop, generally transversely extending trace lying in a vertical plane passing through the center of balance of the balloon and lying at right angles to the verticl plane containing the first trace portion.

The ballast means includes at least one ballast member adapted to adhere to the baloon fixedly with respect to the skin of the envelope, the ballast member being constituted as a plurality of removable weight control modules arranged symmetrically with respect to a plane including the first trace portion of the skin of the balloon.

The positioning and weight of the removable modules is such that they can be removed one or two at a time from the balloon envelope to maintain the altitude of the balloon and to tend to maintain or reestablish the vertical positioning of the planes containing the first and second trace portions of the balloon skin, respectively.

The fastening means used to removably attach the weight control modules to the skin of the balloon may be, for example, a pressure sensitive adhesive. Therefore, if, for any reason, it should be desirable to operate the balloon at a lesser altitude, or to again overcome the lifting effect of the balloon if the balloon is refilled, these weight control modules, or any combination of them, can be replaced.

DETAILED DESCRIPTION OF THE PREFERRED EMBODIMENTS

Figure 1:
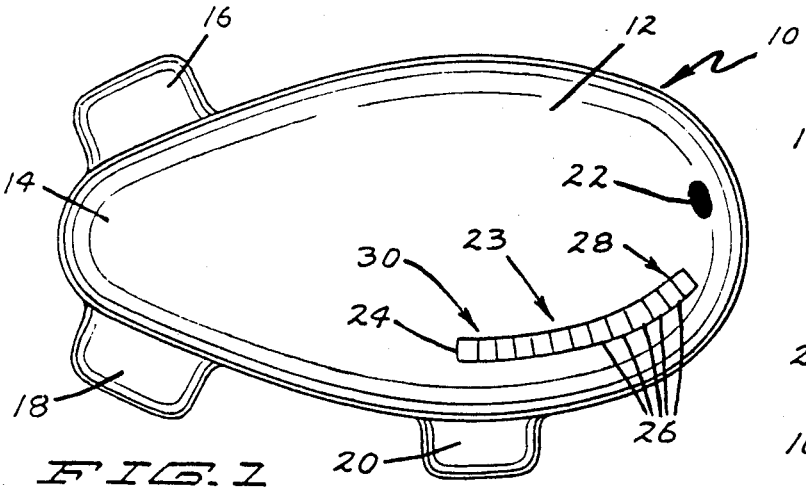
FIG. 1 is a side elevational view of a neutral buoyancy balloon of a first form of the invention shown in the general shape of a blimp and embodying the apparatus of the invention.

A balloon 10 of a first form of the invention as seen in FIGS. 1 through 4 simulates the shape of a familiar hot air non-rigid blimp. It has a front end portion 12 and a rear end portion 14. At the rear of the balloon are hollow protrusions representing upper and lower vertical stabilizers 16 and 18, respectively. In the form of the invention as shown, a centrally disposed hollow protrusion extends from the bottom central portion of the balloon and simulates a gondola 20. An actual toy balloon made according to the present invention will often be provided with protrusions representing right and left horizontal stabilizers and the gondola will be wider and more elaborate. The simplified version shown in FIGS. 1 through 4, however, have been illustrated for simplicity and clarity.

A typical vertical section of the front end portion 12 of the balloon having a longitudinal dimension measured from the nose toward the tail of 30 cm, for example, encompasses more volume than does a similar 30 cm thick vertical section of the rear end portion 14 of the balloon. Full scale balloons, of which the balloon 10 is but a toy replica, are so shaped as to balance, when airborne, with their central longitudinal axis in a horizontal plane, whether the balloon is designed to be captive or free floating. The bulbous front end of such full scale balloons may, therefore, be necessary to balance off the weight of the horizontal and vertical stabilizers, the gondola, or perhaps other equipment carried by the same. It is, of course, advantageous that toy balloons simulate the true shape and attitude of their full scale counterparts. The term "central horizontal axis" used in describing the invention is intended the horizontal axis running from the front to the rear of the balloon.

Figure 4:
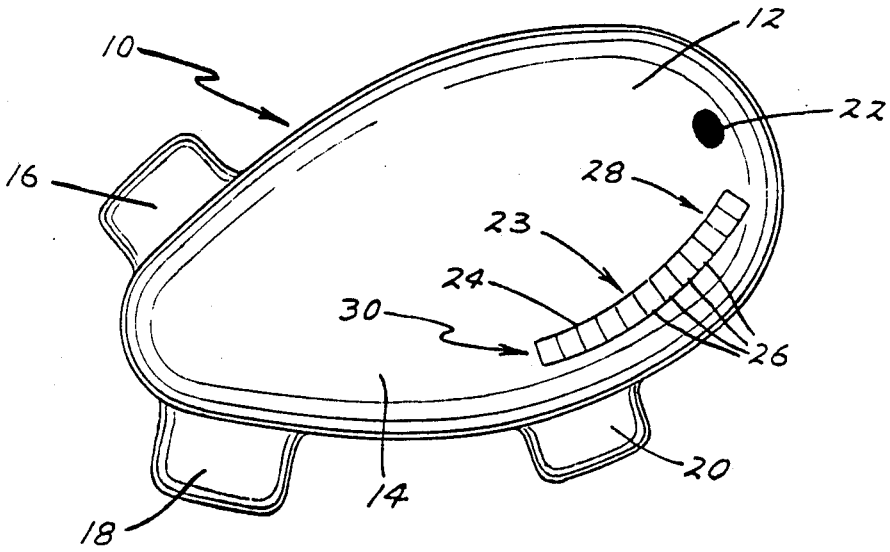
FIG. 4 is a side elevational view showing the change of attitude of the balloon of the first form of the invention due to loss of buoyant gas therefrom and before correction using the appartus and method of the invention.

Vast strides have been made in recent years in constructing balloons which will hold a lighter-than-air gas such as helium for ever and ever more extended periods. However, to date there has always been some leakage, so as time goes on and the gas slowly escapes, weights will have to be removed from the balloon to maintain its neutral buoyancy at a certain height or altitude above the ground. See my U.S. Pat. No. 4,307,537. However, as the lighter-than-air gas escapes from the balloon, and as the balloon slowly descends, the rear end portion 14 of the balloon will descend faster than the front end portion 12 thereof as the weight of the fabric or skin of the balloon including its stabilizers overbalances the smaller volume of lighter-than-air gas per unit of longitudinal measurement more quickly than does the weight of the skin of the front end portion of the balloon overcome the larger volume of gas per unit of longitudinal measurement in the front end portion 12. As time goes on, without correction the balloon will settle down and will also take on an attitude such as seen in FIG. 4.

Stated otherwise, the ratio of weight to volume of the rear end portion 14 of the balloon per unit of linear measurement from the tail of the balloon toward the nose is greater than the corresponding ratio of weight to volume of the front end portion 12 of the balloon for the same linear measurement measuring from the nose of the balloon toward the tail.

Figure 2:
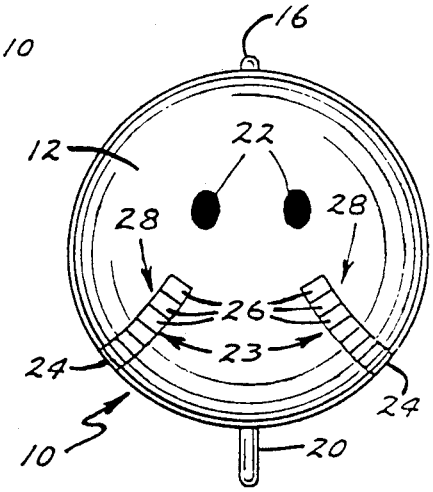
FIG. 2 is a front end view of the balloon of FIG. 1.
Figure 3:
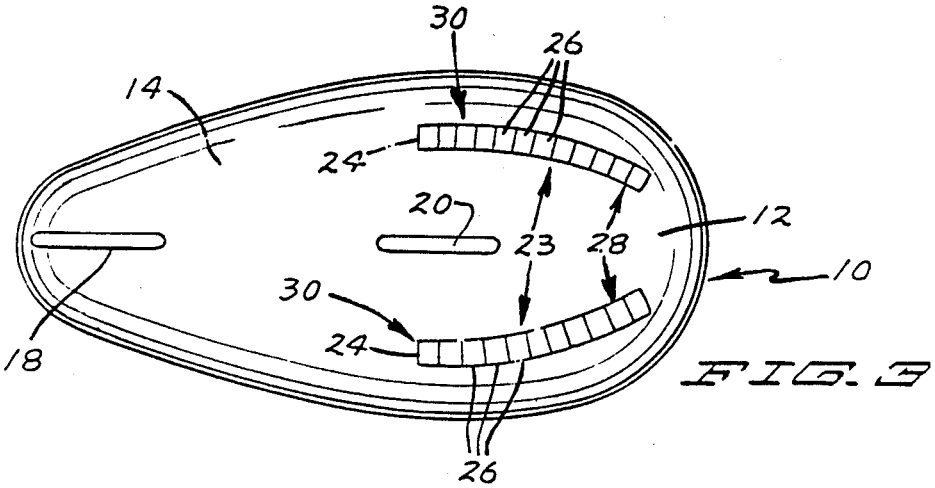
FIG. 3 is a bottom view of the balloon of FIGS. 1 and 2.

When the toy balloon 10 of the first form of the invention is initially "put into service", it can have a pair of counterweights 22, 22 so positioned as to bring the balloon into balance as seen in FIGS. 1, 2 and 3 at a desired altitude or height above the ground or floor in the area and under the atmospheric pressure where the balloon is initially to be used.

The balloon will come equipped with a ballast assembly 23 consisting of a pair of ballast members 24, 24 each made up of a plurality of self-adhesive, individually removable weight control modules 26.

When the toy balloon of the first form of the invention is shipped from the factory, it must have sufficient buoyancy to come to a balance in the atmosphere at the highest point on the surface of the earth at which it may be used, and it must have sufficient counterweights so that it can be balanced in the atmosphere at the lowest point on the surface of the earth where it can be used. Therefore, in the usual situation, when the balloon is first purchased, it will be counterweighted to hover near the ground or to lie on the ground. The balloon can then be put into a neutral buoyancy condition by removing individual removable weight control modules 26 equally from the left and the right side of the balloon either from a forward portion 28 of each ballast member 24 or from a rearward portion 30 of each such ballast member. These control modules 26 will be removed one or two on each side at a time so as to maintain attitude balance to the right and to the left (yaw). They will be taken evenly from the forward portions 28, 28 or the rearward portions 30, 30 of the ballast assembly 23 until a balance in attitude or attack angle is achieved such as shown in FIGS. 1, 2 and 3 at a desired altitude, say at one meter off of the floor, in the room where the balloon is to be used.

It is to be expected, in the usual situation, that it will be expedient for an adult or a more mature child to remove the weight control modules from such forward portions and rearward portions as to achieve the initial balance. At this point, it may also be usual to turn the toy balloon over to a younger child, or to an adult who has not learned how to make this initial altitude and attitude adjustment on the balloon for use. Then, as the gas escapes over several days or weeks and the balloon moves toward an attitude as seen in FIG. 4, it will be necessary to remove individual control modules 26, 26 in matched pairs, one from each side of the balloon to achieve the original altitude or other altitude as desired. In order to do this, to maintain left and right attitude balance and to also move the balloon back into the fore and aft balance or attitude as seen in FIGS. 1 through 3, these individual weight control modules will be removed in pairs from the rearward portions 30, 30 of the ballast members 24, 24.

By carefully determining in advance by experimentation or otherwise the size and the positioning of the ballast assembly 23 including the ballast members and their individual weight control modules and by then so constructing the balloon and ballast assembly at the factory, the fore and aft balance or attitude of the balloon can easily be maintained in the field as long as there is enough gas in the balloon to keep it at the desired altitude or distance from the floor where it is being used.

Figures 5, 6, 7, 8, 9:
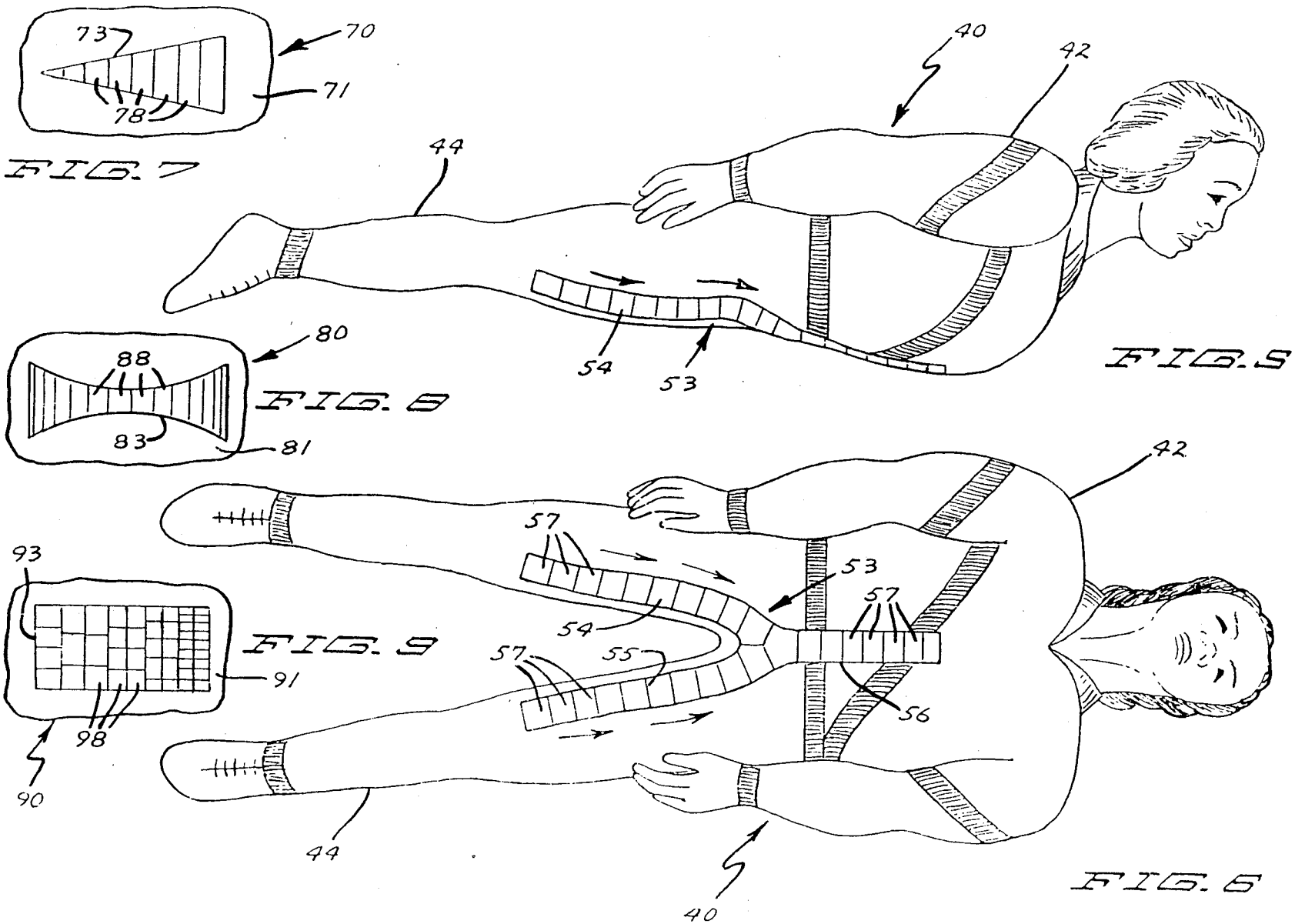
FIG. 5 is a side elevational view of a bulbous balloon of a second form of the invention simulating a human figure in a prone position, and embodying the apparatus of the invention.
FIG. 6 is a bottom plan view of the balloon of FIG. 5.
FIG. 7 is a fragmentary view of a portion of the skin of a neutral buoyancy balloon illustrating a layout of weight control modules forming a ballast member adhered to the skin in a pattern designed to maintain a desired altitude and attitude balance of a neutral buoyancy balloon of a third shape.
FIG. 8 is a fragmentary view of a portion of the skin of a neutral buoyancy balloon illustrating a layout of weight control modules forming a ballast member adhered to the skin in a pattern designed to maintain a desired attitude and altitude of a neutral buoyancy balloon of a fourth shape.
FIG. 9 is a fragmentary view of a portion of the skin of a neutral buoyancy balloon illustrating a layout of weight control modules forming a ballast member adhered to the skin in a pattern designed to maintain a desired altitude and attitude of a neutral buoyancy balloon of a fifth shape.

As seen in FIGS. 5 and 6, a balloon 40 of a second form of the invention is disclosed. In this form, the balloon 40 is also of a bulbous nature in that near one end (the front end to the right as seen in FIGS. 5 and 6), the ratio of balloon weight to volume per unit of linear dimension of a front end portion 42 of the balloon 40 measured along the central horizontal longitudinal axis of the balloon from front toward the rear is less than the corresponding ratio of weight to volume per linear unit of a rear end portion 44 measuring from the rear end portion of the balloon toward the front end portion thereof.

Thus, starting with balloon 40 in the initial attitude balance as seen in FIGS. 5 and 6 and at the desired altitude, as time passes and gas slowly escapes from the balloon, the rear end portion 44 will sink more rapidly than the front end portion 42.

To compensate for this, a ballast assembly 53 is employed. In this case, the ballast assembly consists of right and left ballast control strips 54 and 55, respectively, and central ballast control strip 56. Each such control strip is made up of a plurality of self-adhesive, individually removable weight control modules 57.

As with the balloon 10 of the first form of the invention, weight control modules can be removed from the rear ends of the ballast control strips 54 and 55 and from the front end of the ballast central control strip 56, or can even be removed from intermediate portions of the ballast assembly 53 (from the point where ballast control strips 54, 55 and 56 join together, for example) to initially bring the balloon into altitude or height balance and to maintain it in attitude balance.

Then, to maintain the balloon in fore and aft balance or attitude as gas slowly escapes from the balloon, weight control modules 57 can be removed first from the rear portions of the left and right ballast control strips 54 and 55, and when these are gone, from the rear portion of the central control strip 56.

In this manner, the attitude of the balloon can easily be maintained as long as there is enough gas in the balloon to keep it at the desired altitude or distance from the floor where it is being used.

Balloon 10 of the first form of the invention and balloon 40 of the second form of the invention are but two of an infinite variety of balloons which can be constructed for use in accordance with the present invention. FIGS. 7, 8 and 9 disclose fragmentary portions of skins 71, 81 and 91, respectively, of differently shaped balloons 70, 80 and 90, respectively.

A ballast member 73 is shown affixed to skin 71 at a position on the bottom side of the balloon. Such a ballast member is seen to have weight control modules 78 which will allow the center of gravity or center of balance of the balloon to be shifted slowly when the modules to the left in FIG. 7 are removed and more quickly as the larger, heavier modules 78 to the right are removed.

A ballast member 83 is shown in FIG. 8 to have weight control modules 88 which are heavier in the center and much lighter at either end. If removed from the left end toward the right end, as seen in FIG. 8 for example, the shifting of the center of balance will be slow at first, faster when the middle modules are removed, and then slower at the end. This can be used either to maintain the horizontal attitude of a balloon or, for example, to give some variety to the positioning of the balloon in the air by varying the attitude of the balloon over the active life of the balloon. Also, the center heavier modules can be removed while initially bringing the balloon into height or altitude balance, and then the remaining modules can be removed alternately from one end and then the other to keep the fore and aft balance or attitude under control.

A ballast member 93 having weight control modules 98, as seen adhered to skin 91 of balloon 90 in FIG. 9, allows for very slow movement of the center of balance when its weight control modules 98 are removed serially or otherwise from the right end as seen in FIG. 9; and allows for much faster movement of the center of the balance when the heavier weight control modules 98 are removed from the left as seen in that figure. This configuration will allow gross adjustment to obtain a desired height and a fine or "vernier" adjustment of the attitude, for example.

What is claimed is:

1. In an airbourne, free floating, lift-weight balanced balloon having a closed envelope encompassing a volume of lighter-than-air gas, said envelope having an outer skin defining a fixed maximum volume, which skin is substantially impervious to the passage of said gas therethrough, said balloon being generally symmetrical about a vertical plane which includes the central horizontal axis of the balloon passing through the center of balance of the balloon, said balloon being nonsymmetrical or symmetricl about any vertical plane lying at right angles to said central horizontal axis, said balloon having ballast means fixed in position with respect to the envelope to tend to balance the weight of the balloon to equal the lifting effect of the gas, and to tend to cause the balloon to float in a position such that a first trace portion of the skin of the balloon is established as a closed-loop, generally longitudinally extending trace lying in said vertical plane which includes the central horizontal axis and such that a second trace portion of the skin is established as a closed-loop, generally transversely extending trace lying in a transversely extending vertical plane passing through the center of balance of the balloon and lying at right angles to the horizontal axis of the balloon and to said vertical plane containing the first trace portion, the improvement including:

A. said ballast means including at least one ballast member adapted to be adhered to the balloon fixedly with respect to the skin of the envelope, said at least one ballast member being constituted as a plurality of weight control modules arranged symmetrically with respect to said vertical plane containing the first trace portion;

B. the positioning and weight of the modules being such that, as they are serially removed from the envelope to maintain the altitude balance of the balloon, the order of their removal can be such as to tend to maintain the first and second trace portions of the balloon skin in truly vertical planes each plane passing through the center of balance of the balloon;

C. fastening means operative to cause said modules to adhere in fixed position with respect to the skin of the envelope, and to allow said modules to be removed from said fixed position with respect to said skin; and D. said fastening means and said ballast member constituting at least part of said ballast means.

2. The structure of claim 1 wherein:

E. a first half of the balloon measured from the center of the central horizontal axis to a first end of the balloon encompasses more volume per unit of weight than a second half thereof measured from the center of the central horizontal axis to a second opposite end of the balloon; and F. said at least one ballast member includes a plurality of weight control modules adhered to the envelope skin and lying in symmetrical relation about said vertical plane containing the first trace portion.

3. The structure of claim 1 wherein:

E. there are two ballast members, one situated on each side of the vertical plane containing said first trace portion of the balloon skin.

4. The structure of claim 2 wherein:

G. there are two ballast members, one situated on each side of the vertical plane containing said first trace portion of the balloon skin.

5. The structure of claim 4 wherein:

H. the balloon is bifurcated at its second end portion; and

I. one of the two said ballast members extends along each of the legs of the bifurcation.

6. The structure of claim 5 wherein:

j. a third ballast member extends along the first trace portion of the nonbifurcated part of the balloon.

7. A method of maintaining a desired altitude and attitude of a balloon which is generally symmetrical about a vertical plane which includes the central horizontal axis of the balloon passing through the center of balance of the balloon and which is nonsymmetrical or symmetrical about any vertical plane lying at right angles to said central horizontal axis; said balloon having ballast means initially ballasting the balloon to float at an altitude below the desired altitude and to tend to cause the balloon to float in a position such that (1) a first trace portion of the skin of the balloon is established as a closed-loop, generally longitudinally extending trace lying in said vertical plane which includes the central horizontal axis, and (2) a second trace portion of the skin is established as a closed-loop, generally transversely extending trace lying in a transversely extending vertical plane passing through the center of balance of the balloon and lying at right angles to said vertical plane containing the first trace portion; the ballast means including a plurality of removable weight control modules adhered to the skin of the balloon; the method including the steps of:

A. removing weight control modules one after another until the balloon floats at the desired altitude;

B. releasing the balloon in the air after at least one weight control module has been removed according to the previous step and allowing the balloon to move toward its attitude of balance;

C. observing any deviation in the positioning of the balloon to tend to displace the second trace portion of the balloon skin from its vertical plane passing through the center of balance of the balloon; and D. removing subsequent weight control modules from the balloon skin from locations which will lighten a portion of the balloon which will tend to cause the balloon to float at an attitude in which the second trace portion of the balloon skin will lie in its vertical plane passing through the center of balance of the balloon.

8. A method of maintaining a desired altitude and attitude of a balloon which is generally symmetrical about a vertical plane which includes the central horizontal axis of the balloon passing through the center of balance of the balloon and which is nonsymmetrical or symmetrical about any vertical plane lying at right angles to said central horizontal axis; said balloon having ballast means initially ballasting the balloon to float at an altitude below the desired altitude and to tend to cause the balloon to float in a position such that (1) a first trace portion of the skin of the balloon is established as a closed-loop, generally longitudinally extending trace lying in said vertical plane which includes the central horizontal axis, and (2) a second trace portion of the skin is established as a closed-loop, generally transversely extending trace lying in a transversely extending vertical plane passing through the center of balance of the balloon and lying at right angles to said vertical plane containing the first trace portion; the ballast means including a plurality of removable weight control modules adhered to the skin of the balloon; the method including the steps of:

A. removing weight control modules one after another until the balloon floats at the desired altitude;

B. releasing the balloon in the air after at least one weight control module has been removed according to the previous step and allowing the balloon to move toward its attitude of balance;

C. observing any deviation in the positioning of the balloon to tend to displace the first trace portion of the balloon skin from its vertical plane passing through the center of balance of the balloon;

D. observing any deviation in the positioning of the balloon to tend to displace the second trace portion of the balloon skin from its vertical plane passing through the center of balance of the balloon; and E. removing subsequent weight control modules from the balloon skin from locations which will lighten portions of the balloon which will tend to cause the balloon to float at an attitude in which the first trace and second trace portions of the balloon skin will lie in their respective vertical planes passing through the center of balance of the balloon.

9. A method of maintaining a desired altitude and attitude of a balloon which is generally symmetrical about a vertical plane which includes the central horizontal axis of the balloon passing through the center of balance of the balloon and which is nonsymmetrical or symmetrical about any vertical plane lying at right angles to said central horizontal axis said balloon having ballast means initially ballasting the balloon to float at an altitude below the desired altitude; and to tend to cause the balloon to float in a position such that (1) a first trace portion of the skin of the balloon is established as a closed-loop, generally longitudinally extending trace lying in said vertical plane which includes the central horizontal axis, and (2) a second trace portion of the skin is established as a closed-loop, generally transversely extending trace lying in a transversely extending vertical plane passing through the center of balance of the balloon and lying at right angles to said vertical plane containing the first trace portion; the ballast means including a plurality of removable weight control modules adhered to the skin of the balloon; the ballast means also including two ballast members, one situated on each side of the vertical plane containing the first trace portion of the balloon skin; the balloon being bifurcated at a second end portion thereof; and one of the two said ballast members extends along each of the legs of the bifurcation; the method including the steps of, A. removing the weight control modules one after another until the balloon floats at the desired altitude;

B. removing the weight control modules according to the previous step two at a time, a first module being from a first of the two ballast members and the second module being from the second ballast member and being a module which was symmetrically spaced with respect to the first module;

C. releasing the balloon in the air after at least one symmetrically located pair of weight control modules has been removed according to the first step above and allowing the balloon to move toward its attitude of balance;

D. observing any deviation in the positioning of the balloon to tend to displace the second trace portion of the balloon skin from its vertical plane; and E. removing subsequent pairs of weight control modules from the balloon skin from locations which will lighten that portion of the balloon which will tend to cause the balloon to float at an attitude in which the second trace portion of the balloon skin will lie in its vertical plane.

* * * * *